US006452552B1

(12) United States Patent
Ishitobi et al.

(10) Patent No.: US 6,452,552 B1
(45) Date of Patent: Sep. 17, 2002

(54) MICROSTRIP ANTENNA

(75) Inventors: Norimasa Ishitobi; Nobutaka Misawa, both of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/924,584

(22) Filed: Aug. 9, 2001

Related U.S. Application Data

(63) Continuation of application No. PCT/JP00/07821, filed on Nov. 8, 2000.

(30) Foreign Application Priority Data

Dec. 15, 1999 (JP) ..... 11-355728

(51) Int. Cl.[7] ..... H01Q 1/38; H01Q 13/10

(52) U.S. Cl. ..... 343/700 MS; 343/770; 343/767

(58) Field of Search ..... 343/702, 767, 343/770, 700 MS, 771, 768

(56) References Cited

U.S. PATENT DOCUMENTS

| | | | | | |
|---|---|---|---|---|---|
| 4,958,165 | A | * | 9/1990 | Axford et al. | 343/770 |
| 5,245,745 | A | | 9/1993 | Jensen et al. | 29/600 |
| 5,406,292 | A | * | 4/1995 | Schnetzer et al. | 343/700 MS |
| 5,410,323 | A | | 4/1995 | Kuroda | 343/700 MS |
| 5,581,266 | A | * | 12/1996 | Peng et al. | 343/770 |
| 6,239,762 | B1 | * | 5/2001 | Lier | 343/770 |

FOREIGN PATENT DOCUMENTS

| | | |
|---|---|---|
| JP | 58-215808 | 12/1983 |
| JP | 5-29827 | 2/1993 |
| JP | 5-152830 | 6/1993 |
| JP | 6-276015 | 9/1994 |
| JP | 8-195619 | 7/1996 |
| JP | 9-326628 | 12/1997 |
| JP | 11-74721 | 3/1999 |

OTHER PUBLICATIONS

Abstract of WO 01/45207 A1, Nov. 8, 2000.
IEICE, vol. J71–B No. 11, p. 1394, Nov., 1988.

* cited by examiner

*Primary Examiner*—Don Wong
*Assistant Examiner*—James Clinger
(74) *Attorney, Agent, or Firm*—Armstrong, Westerman & Hattori, LLP

(57) ABSTRACT

A microstrip antenna includes a rectangular dielectric substrate, a ground plate conductor formed on one surface of the dielectric substrate, a rectangular radiating conductor formed on the other surface of the dielectric substrate, a crossed slot formed in the radiating conductor and provided with two arms extended along orthogonal sides of the radiating conductor, the two arms having lengths different from each other, and at least one power-supply point formed on a diagonal line of the radiating conductor or an extension line of the diagonal line but different from a center of the radiating conductor. The length of at least one of the arms is equal to or more than a value obtained by subtracting a four times value of a thickness of the dielectric substrate from a length of a side of the radiating conductor along the arm.

10 Claims, 12 Drawing Sheets

MICROSTRIP ANTENNA

CROSS-REFERENCES TO RELATED APPLICATIONS

This is a continuation of International Application PCT/JP00/07821, with an international filing date of Nov. 8, 2000.

FIELD OF THE INVENTION

The present invention relates to a microstrip antenna used as a built-in antenna of a portable telephone or mobile terminal for example.

DESCRIPTION OF THE RELATED ART

A $\lambda/2$ patch antenna is a typical microstrip antenna to be built in a portable telephone or a mobile terminal such as a GPS. In this case, $\lambda$ denotes a wavelength in a frequency used.

This antenna is mainly constituted of a dielectric substrate having a rectangular or circular radiating conductor (patch conductor) with a side length or a diameter of approximately $\lambda/2$ on one face and having a ground plate conductor on the other face.

It has been recently requested to further downsize the portable telephone and mobile terminal and thereby, it is requested to further downsize a built-in type patch antenna. A dielectric substrate with a high dielectric constant is typically used to physically downsize the patch antenna with the above-mentioned patch conductor dimension of approximately $\lambda/2$.

However, the relative dielectric constant of a dielectric material having a low temperature coefficient suitable for a high frequency is up to $\epsilon_r$ of approximately 110 and therefore, it is limited to downsize an antenna by raising the dielectric constant of the dielectric material. Since a dielectric material becomes more expensive by raising its dielectric constant, the cost for fabricating a microstrip antenna will increase if such raised dielectric constant material is used.

Japanese patent publication No. 05152830 A (U.S. Pat. No. 2,826,224) discloses, as a known art for downsizing a microstrip antenna without raising the dielectric constant of the dielectric material, to produce two resonant modes orthogonal to each other and having phases different from each other by forming a degenerate separation element, to form a power-supply point in a straight-line direction orthogonal to the direction of the resonant mode at ±45°, and to form notches at the both ends in the straight-line direction of the radiating conductor. By forming such notches, it is possible to equivalently increase electric lengths of two resonant modes, and lower a resonance frequency. Therefore, it is possible to downsize the antenna element to a certain extent.

Japanese patent publication No. 06276015 A discloses, as a known art of a microstrip antenna, that two crossing slots with different lengths from each other are formed as a degenerate separation element in a radiating conductor and that notches or stubs are formed at the outer edge of the radiating conductor in order to adjust the inductance component of the radiating conductor.

Japanese patent publication No. 09326628 A discloses, as another known art of a microstrip antenna, that two resonance characteristics for generating two modes with different route lengths from each other are obtained by forming a crossed cutout with two arm lengths different from each other on a square radiating plate so that these symmetry axes coincide with two diagonal lines of the plate, respectively.

However, according to the known art disclosed in Japanese patent publication No. 05152830 A (U.S. Pat. No. 2,826,224), because the notches are formed only the both ends of the radiating conductor in the direction coinciding with the power-supply point of the conductor and a current-route width is not changed at the central portion of the radiating conductor corresponding to an antinode of current flowing under resonance, it cannot be expected to greatly reduce a resonance frequency. Furthermore, since a capacitance with respect to ground is reduced by forming the notches at the both ends of the radiating conductor corresponding to antinodes of voltage under resonance, it cannot be also expected to greatly reduce the resonance frequency. Therefore, it is difficult to extremely downsize the microstrip antenna.

Although Japanese patent publication No. 06276015 A discloses to form two crossing slots having different lengths from each other as a degenerate separation element, it is silent for downsizing an antenna element. In this disclosed art furthermore, since notches or stubs are formed at the outer edge of the radiating conductor, it is impossible to effectively use the limited surface area of a dielectric substrate for improving the radiation efficiency.

In addition, although Japanese patent publication No. 09326628 A discloses that two resonance characteristics are obtained by forming a crossed cutout with two arm lengths different from each other so that symmetry axes coincide with diagonal lines of a radiation plate, it is silent for downsizing an antenna element at all. Moreover, because the position of the power-supply point is present on a vertical line passing through the center of a side, it is very difficult to mount an antenna element when it is downsized and its terminal interval is decreased.

SUMMARY OF THE INVENTION

It is therefore an object of the present invention to provide a microstrip antenna, whereby further downsizing can be expected.

Another object of the present invention is to provide a microstrip antenna, whereby its radiation efficiency can be improved by effectively using the limited surface area of a dielectric substrate.

A further object of the present invention is to provide a microstrip antenna, whereby a power-supply point is located at an easily-mounting position.

According to the present invention, a microstrip antenna includes a rectangular dielectric substrate, a ground plate conductor formed on one surface of the dielectric substrate, a rectangular radiating conductor formed on the other surface of the dielectric substrate, a crossed slot formed in the radiating conductor and provided with two arms extended along orthogonal sides of the radiating conductor, the two arms having lengths different from each other, and at least one power-supply point formed on a diagonal line of the radiating conductor or an extension line of the diagonal line but different from a center of the radiating conductor. The length of at least one of the arms is equal to or more than a value obtained by subtracting a four times value of a thickness of the dielectric substrate from a length of a side of the radiating conductor along the arm.

Thus, according to the present invention, the length of at least one of the two arms of the crossed slot, parallel with orthogonal sides of the radiating conductor is set so as to be equal to or more than a value obtained by subtracting a four times value of the thickness of the dielectric substrate from the length of the side of the radiating conductor in that direction. That is, if it is assumed that a central point of each arm is located at the center of the radiating conductor, the distance between the top end of at least one arm of the slot and outer edge of the radiating conductor is set so that the distance becomes equal to or less than a double value of the thickness of the dielectric substrate. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. Thus, by making a region with a low potential more inductive, the resonance frequency lowers resulting that dimensions of a microstrip antenna are further decreased.

Particularly, according to the present invention, the distance between the top end of at least one arm of the slot and the outer edge of the radiating conductor, in other words, the width of a current route serving as an antinode of current in the current route under resonance is set so as to be equal to or less than a double value of the thickness of the dielectric substrate. Therefore, a resonance frequency is greatly lowered and as a result, it is possible to further downsize an antenna.

Furthermore, since at least one power-supply point is located on a diagonal line or an extension line of the diagonal line except a center of the radiating conductor and located at a corner of the radiating conductor, it is possible to easily perform wiring and mounting for power supply.

It is preferred that the length of each arm of the slot is equal to or more than a value obtained by subtracting a four times value of a thickness of the dielectric substrate from a length of a side of the radiating conductor along the arm.

It is also preferred that ends of the slot are rounded. By rounding the ends, it is prevented that current is concentrated on a part of each end and a conductor loss increases. That is, the flow of the current at the end becomes smooth and it is possible to reduce the conductor loss without increasing a pattern in size and therefore, it is possible to improve the Q due to the conductor loss.

It is preferred that at least one cutout or stub is formed at a crossing portion of the slot. By forming at least one cutout or stub for adjusting impedance characteristic and frequency characteristic on the slot and forming the radiating conductor as large as possible in the limited surface area of the dielectric substrate, it is possible to improve the area-utilization rate and radiation efficiency of the antenna. In this case, preferably at least one cutout or stub is formed on a diagonal line of the radiating conductor.

It is also preferred that the radiating conductor has a square shape and the arms of the slot tilt by ±45° from a diagonal line on which the at least one power-supply point is present.

It is preferred that the antenna further includes an electrostatic coupling pattern constituted by cutting out a part of the radiating conductor to connect the at least one power-supply point with the radiating conductor. Since the electrostatic coupling pattern is formed by cutting out a part of the radiating conductor and at least one power-supply point is formed, it is possible to further improve the utilization efficiency of the radiating conductor.

It is also preferred that a thickness of the dielectric substrate is equal to or less than a ¼ wavelength of a frequency used.

It is preferred that a length of a side of the dielectric substrate is equal to or less than a value obtained by adding a thickness of the dielectric substrate to a length of a side of the radiating conductor along the side of the dielectric substrate. In general, it is estimated that a side-fringing electric field becomes weaker as further separating from the outer edge of the radiating conductor and that the intensity of the electric field is decreased to approximately ½ at a position a half thickness of the dielectric substrate separate from the substrate. To effectively use the surface of a dielectric substrate, it is preferable to form the radiating conductor up to the outer edge of the dielectric substrate. In this case, however, most side-fringing electric field leaks to the outside of the substrate. Therefore, the distance between the outer edge of the dielectric substrate and that of the radiating conductor is set so as to be equal to or less than ½ of the thickness of the dielectric substrate by considering the end capacity effect and effective use of the dielectric substrate surface.

It is preferred that two power-supply points are provided at two positions that are point-symmetric to a center of the radiating conductor, respectively. Thereby, it is possible to directly connect the power-supply points of the antenna to an active circuit such as a differential amplifier and directly supply a signal having a phase difference of 180°.

Further objects and advantages of the present invention will be apparent from the following description of the preferred embodiments of the invention as illustrated in the accompanying drawings.

DESCRIPTION OF THE PREFERRED EMBODIMENTS

Figure 1A:
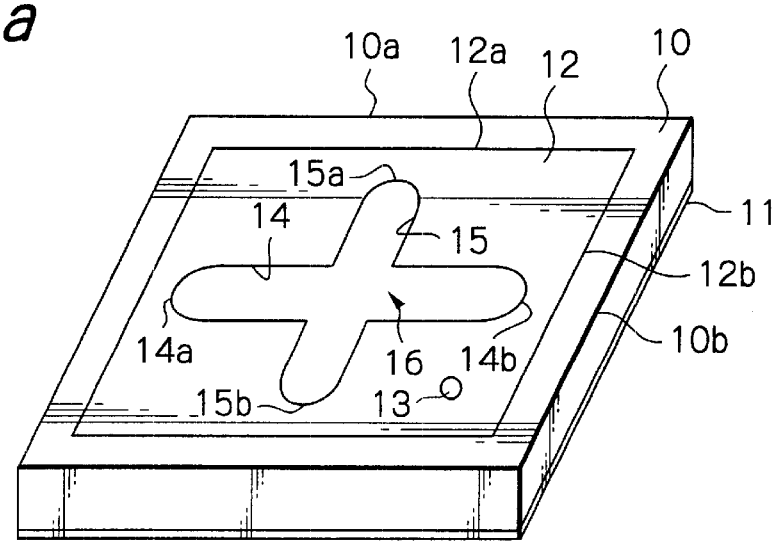
FIG. 1*a* is a perspective view schematically illustrating a configuration of a preferred embodiment of a microstrip antenna according to the present invention.
Figure 1B:
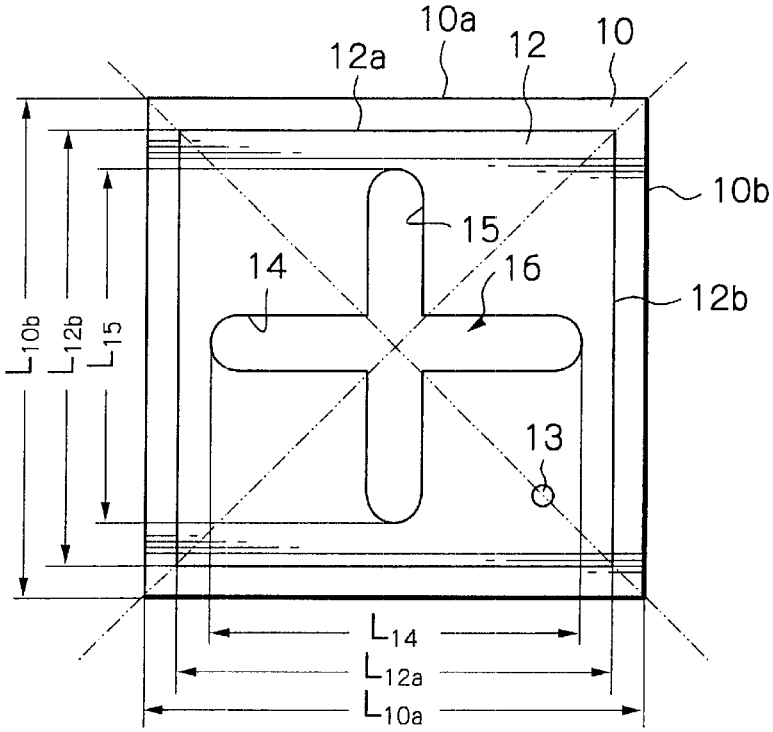
FIG. 1*b* is a top view illustrating a radiating conductor pattern of the microstrip antenna shown in FIG. 1*a;*

FIGS. 1*a* and 1*b* schematically illustrate a configuration of a preferred embodiment of a microstrip antenna according to the present invention, in which FIG. 1*a* is a perspective view of the configuration and FIG. 1*b* is a top view illustrating a radiating conductor pattern of the configuration.

In these figures, reference numeral 10 denotes a square or rectangular dielectric substrate, 11 denotes a ground plate conductor (ground electrode) formed on the entire back surface of the dielectric substrate 10, 12 denotes a square or rectangular radiating conductor (patch electrode) formed on the front surface of the dielectric substrate 10, and 13 denotes a power-supply terminal.

The dielectric substrate 10 is made of a high-frequency-purposed ceramic dielectric material with a relative dielectric constant $\epsilon_r \approx 90$. A thickness of the substrate 10 is set to a value equal to or less than a ¼ wavelength of a frequency used.

The ground plate conductor 11 and the radiating conductor 12 are formed by patterning a metallic conductor layer made of copper or silver on the back and front surfaces of the dielectric substrate 10, respectively. Specifically, one of the following methods is used for forming these conductors; a method of pattern-printing metallic paste such as silver and baking it, a method of forming a patterned metallic layer through plating, and a method of patterning a thin metallic film through etching.

The power-supply terminal 13 is formed at one point located on a diagonal line of the radiating conductor 12 different from the central point of the radiating conductor 12 and electrically connected to the radiating conductor 12. A not-illustrated power-supply line is connected to the power-supply terminal 13. This power-supply line passes through the dielectric substrate 10 to the back side of the substrate 10 and connected to a transceiver circuit or the like. It is a matter of course that this power-supply line is electrically insulated from the ground plate conductor 11.

A crossed slot 16 constituted of two arms 14 and 15 parallel with orthogonal sides 12*a* and 12*b* of the radiating conductor 12 is formed at the central portion of the radiating conductor 12. When the shape of the radiating conductor 12 is square, these arms 14 and 15 tilt by ±45° from the diagonal line on which the power-supply point 13 is present.

Lengths of these arms 14 and 15 are different from each other and both ends 14*a* and 14*b* of the arm 14 and both ends 15*a* and 15*b* of the arm 15 are respectively rounded like a circular arc. In this embodiment, lengths $L_{14}$ and $L_{15}$ of the arms 14 and 15 are set as $L_{14}>L_{15}$. By making lengths of the arms 14 and 15 different from each other to shift resonance frequencies of two orthogonal resonance modes from each other in order to obtain a double-resonance characteristic, an antenna-operating band can be widened.

Also, the lengths $L_{14}$ and $L_{15}$ of the arms 14 and 15 are set as $L_{14} \geqq L_{12a}-4T$ or $L_{15} \geqq L_{12b}-4T$, where $L_{12a}$ and $L_{12b}$ are lengths of the sides 12*a* and 12*b* of the radiating conductors 12 and T is the thickness of the dielectric substrate 10. That is, the length $L_{14}$ or $L_{15}$ of the arm 14 or 15 is set to a value equal to or more than a value obtained by subtracting 4T that is a four times value of the thickness T of the dielectric substrate 10 from the length $L_{12a}$ or $L_{12b}$ of the side 12*a* or 12*b* of the radiating conductor 12 along the arm 14 or 15.

This means that, if central points of the arms 14 and 15 are located at the center of the radiating conductor 12, the distance between the top end of the arm 14 or 15 and the outer edge of the radiating conductor 12 is set to a value equal to or less than 2T that is a double value of the thickness T of the dielectric substrate 10. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

Table 1 is the results of experimentally obtaining the relationship between current-route width (W) and resonance frequency ($f_0$) when a radiating conductor is formed on the entire surface of a dielectric substrate with a size of 6×6×1 mm.

TABLE 1

| Current-route width W (mm) | 3.00 | 2.50 | 2.00 | 1.50 | 1.00 | 0.75 | 0.50 | 0.25 |
|---|---|---|---|---|---|---|---|---|
| Resonance frequency $f_0$ (GHz) | 3.02 00 | 2.99 75 | 2.93 75 | 2.78 75 | 2.57 00 | 2.45 75 | 2.32 25 | 2.20 25 |

Figure 2:
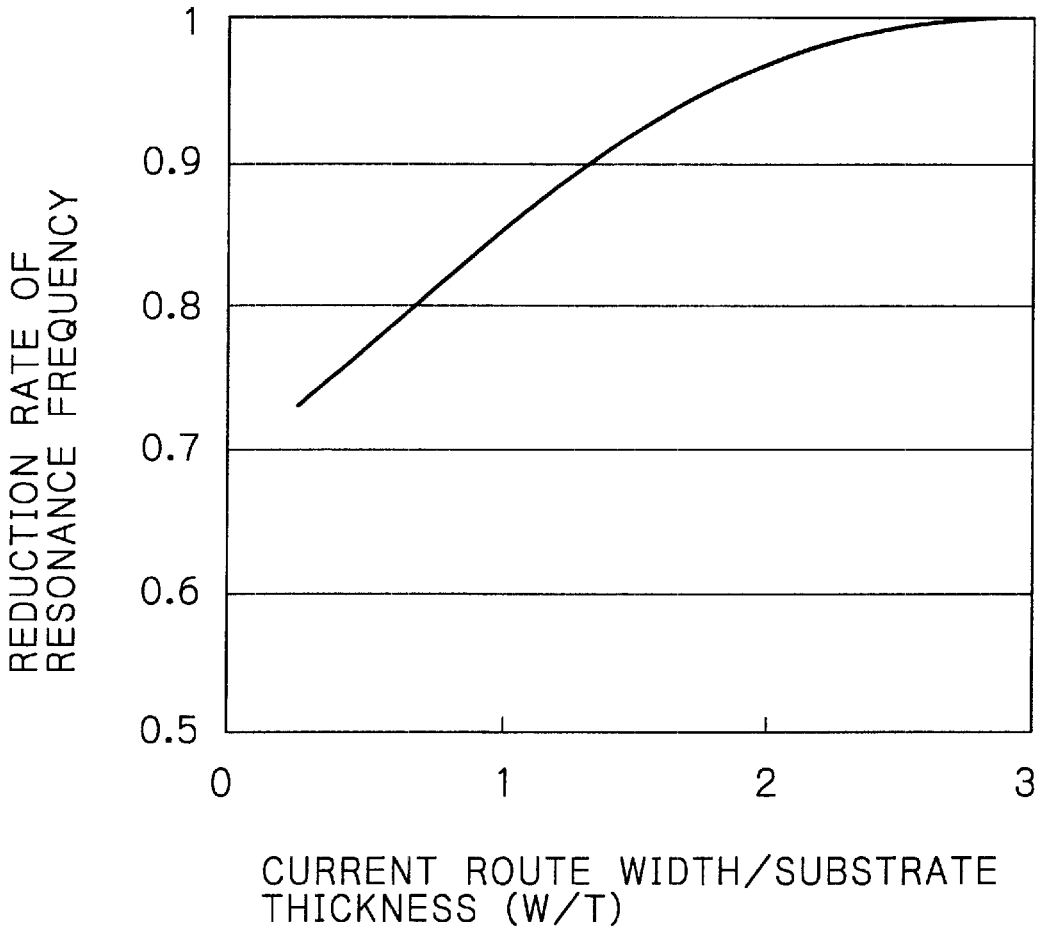
FIG. 2 is an experimental characteristic diagram illustrating a rate of downsizing to a current-route width expressed by using an experiment result in Table 1.

FIG. 2 is an experimental characteristic diagram illustrating a rate of downsizing with respect to a current-route width, shown by using the experiment results in Table 1, in which the horizontal axis represents current-route width/dielectric-substrate thickness (W/T, T=1 mm) and the vertical axis represents the reduction rate of the resonance frequency $f_0$.

As will be noted from FIG. 2, when W/T becomes 2 or less, the resonance frequency $f_0$ suddenly decreases. Therefore, it is possible to effectively downsize an antenna by setting the distance between the top end of the slot arm 14 or 15 and the outer edge of the radiating conductor 12 (current-route width W) to a value equal to or less than 2T that is a double value of the thickness T of the dielectric substrate 10, in other words, by setting the length of the arm 14 or 15 to a value equal to or more than a value obtained by subtracting 4T that is a four times value of the thickness T of the dielectric substrate 10 from the length of a side of the radiating conductor 12 along the arm.

In this embodiment, because the power-supply point 13 is located near a corner of the radiating conductor 12, an antenna can be easily mounted even if it is downsized and the terminal interval of the antenna narrows.

Moreover, since the ends 14*a* and 14*b* and 15*a* and 15*b* of the arms of the slot are rounded, it is prevented that current is concentrated on a part of these ends and the conductor loss increases. That is, current smoothly flows through the ends and the conductor loss can be reduced without causing a pattern to increase in size, and thereby, it is possible to improve Q.

In case of the chip antenna of this embodiment, lengths $L_{10a}$ and $L_{10b}$ of sides 10*a* and 10*b* of the dielectric substrate 10 are set to values equal to or less than values obtained by adding the thickness T of the dielectric substrate 10 to lengths $L_{12a}$ and $L_{12b}$ of sides 12*a* and 12*b* of the radiating conductor 12 along the sides 10*a* and 10*b* of the dielectric substrate 10. That is, the lengths $L_{10a}$ and $L_{10b}$ are respectively as $L_{10a} \leqq L_{12a}+T$ or $L_{10b} \leqq L_{12b}+T$.

In general, it is estimated that a side-fringing electric field becomes weaker as further separating from the outer edge of the radiating conductor 12 and is almost halved at a position T/2 separate from the outer edge. To effectively use the surface area of the dielectric substrate 10, it is necessary to form the radiating conductor 12 up to the outer edge of the dielectric substrate 10. In this case, however, most of the side-fringing electric field is leaked to the outside of the dielectric substrate 10. Therefore, for the even balance between end capacity effect and effective use of dielectric substrate surface, the distance between the outer edge of the dielectric substrate 10 and that of the radiating conductor 12 is set to a value equal to or less than ½ of the thickness T of the dielectric substrate 10.

As a specific microstrip antenna of this embodiment, a dielectric material having a relative dielectric constant $\epsilon_r \approx 90$ is formed into the dielectric substrate 10 having a size of 6×6×1 mm, and the ground plate conductor 11 is formed on the entire back surface of the substrate 10 and the radiating conductor 12 is formed on the front surface of the substrate 10 at respective film thickness. The radiating conductor 12 has dimensions of $L_{12a} \times L_{12b}$=5.4×5.4 mm and the crossed slot 16 is set to the center of the radiating conductor 12. The arms 14 and 15 of the slot 16 respectively have a width of 0.771 mm which corresponds to 1/7 of the length of a side of the radiating conductor 12. The arm 14 has a length of $L_{14}$=4.628 mm and the arm 15 has a length of $L_{15}$=4.428 mm. Ends of these arms respectively have a circular arc with a radius of curvature of 0.3855 mm.

Figure 3:
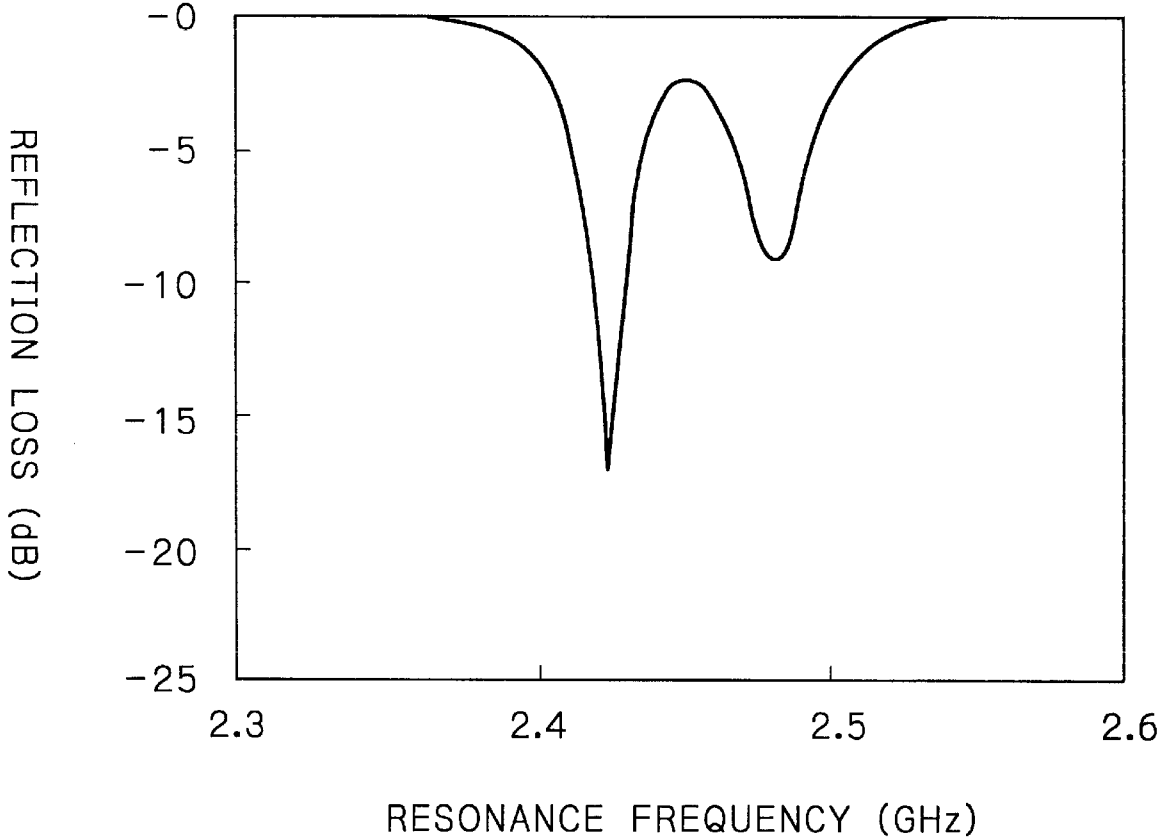
FIG. 3 is a characteristic diagram obtained by actually measuring a frequency characteristic of the microstrip antenna of the embodiment shown in FIGS. 1*a* and 1*b;*

FIG. 3 is a characteristic diagram obtained by actually measuring the frequency characteristic of this microstrip antenna, in which the horizontal axis represents resonance frequency (GHz) and the vertical axis represents reflection loss (dB). Thus, resonance frequencies of two orthogonal resonance modes are shifted from each other and thereby, a double-resonance characteristic is obtained and the band of the antenna is widened.

Figure 4A:
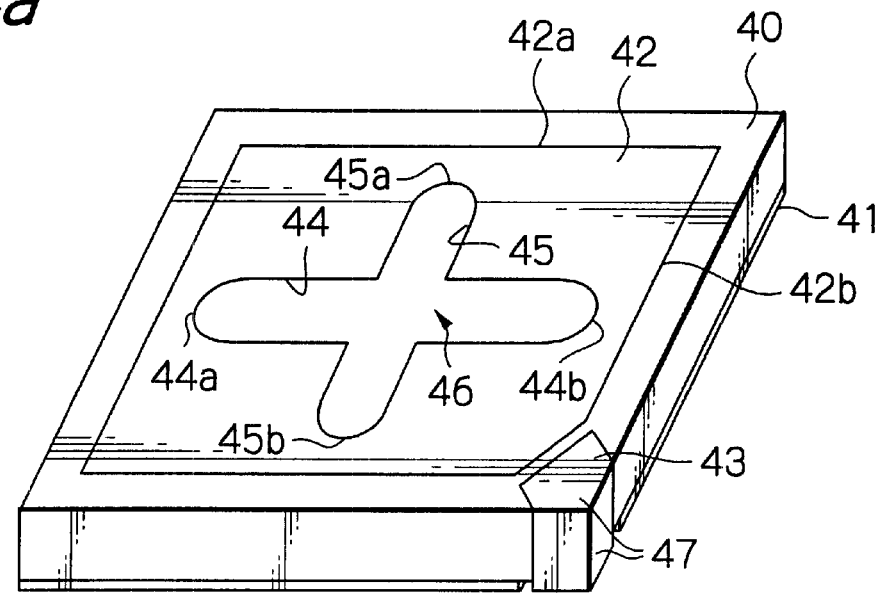
FIG. 4*a* is a perspective view schematically illustrating a configuration of another embodiment of the microstrip antenna according to the present invention.
Figure 4B:
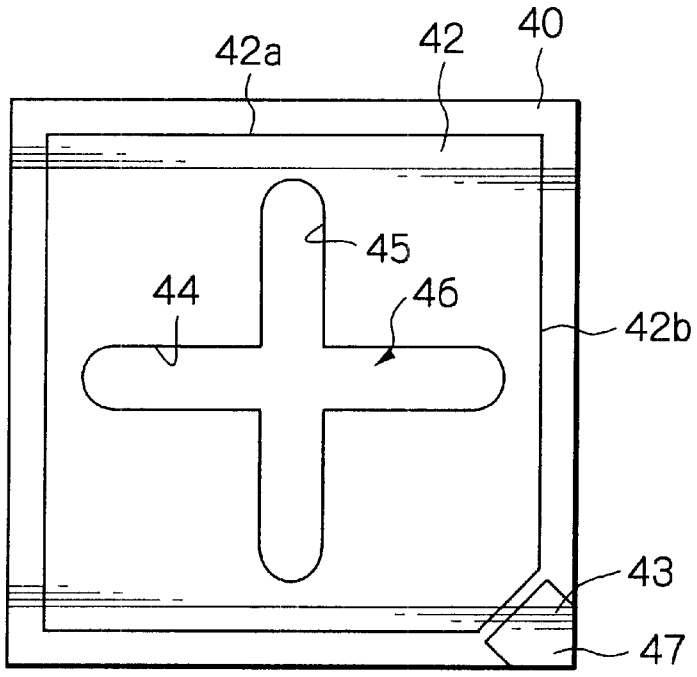
FIG. 4*b* is a top view illustrating a radiating conductor pattern of the microstrip antenna shown in FIG. 4*a;*

FIGS. 4*a* and 4*b* schematically illustrate a configuration of another embodiment of a microstrip antenna according to the present invention, in which FIG. 4*a* is a perspective view of the configuration and FIG. 4*b* is a top view illustrating a radiating conductor pattern of the configuration.

In these figures, reference numeral 40 denotes a dielectric substrate, 41 denotes a ground plate conductor (ground electrode) formed over the entire area except the power-supply electrode on the back surface of the substrate 40, 42 denotes a square or rectangular radiating conductor (patch electrode) formed on the front surface of the dielectric substrate 40, and 43 denotes a power-supply terminal.

The dielectric substrate 40 is made of a high-frequency-purposed ceramic dielectric material having a relative dielectric constant $\epsilon_r \approx 90$. The thickness of the substrate 40 is set to a value equal to or less than a ¼ wavelength of a frequency used.

The ground plate conductor 41 and radiating conductor 42 are respectively formed by patterning a metallic conductor layer made of copper or silver on the back and front surfaces of the dielectric substrate 40. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 43 is formed into a shape obtained by cutting out a part of the radiating conductor 42 like a triangle shape at one of corners of the radiating conductor 42 on the extension line of a diagonal line of the radiating conductor 42 and electrically connected to the radiating conductor 42 by an electrostatic coupling pattern. The power-supply terminal 43 is electrically connected to a not-illustrated power-supply electrode formed on the back surface of the dielectric substrate 40 through a power-supply conductor 47 passing through the side face of the dielectric substrate 40. The power-supply electrode is electrically insulated from the ground plate conductor 41 and will be connected to a transceiver circuit or the like.

Since the power-supply terminal 43 is formed as an electrostatic coupling pattern obtained by cutting out a part of the radiating conductor 42, the structure of the terminal 43 is greatly simplified and thereby easily fabricated, and easily mounted because the terminal 43 can be connected with other circuit only by its surface. Moreover, by forming the radiating conductor 42 as large as possible in the limited surface area of the dielectric substrate 40, it is possible to improve the area-utilization rate and the radiation efficiency.

A crossed slot 46 constituted of two arms 44 and 45 parallel with orthogonal sides 42*a* and 42*b* of the radiating conductor 42 is formed on the radiating conductor 42. When the shape of the radiating conductor 42 is square, these arms 44 and 45 tilt by ±45° from the diagonal line on which a power-supply point is present.

Lengths of these arms 44 and 45 are different from each other and both ends 44*a* and 44*b* of the arm 44 and both ends 45*a* and 45*b* of the arm 45 are respectively rounded like a circular arc. By making lengths of the arms 44 and 45 different from each other to shift resonance frequencies of two orthogonal resonance modes each other in order to obtain a double-resonance characteristic, the operating band of an antenna can be widened.

Also, the length of the arm 44 or 45 is set to a value equal to or more than a value obtained by subtracting 4T that is a four times value of the thickness T of the dielectric substrate 40 from the length of the side 42*a* or 42*b* of the radiating conductor along the arm 44 or 45. This means that, if central points of the arms 44 and 45 are located at the center of the radiating conductor 42, the distance between the top end of the arm 44 or 45 and the outer edge of the radiating conductor 42 is set to a value equal to or less than 2T that is a double value of the thickness T of the dielectric substrate 40. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

Moreover, since the ends 44*a* and 44*b* and 45*a* and 45*b* of arms of the slot are rounded, it is prevented that current is concentrated on a part of these ends and the conductor loss increases. That is, current smoothly flows through the ends and the conductor loss can be reduced without causing a pattern to increase in size. Therefore, it is possible to raise the Q due to the conductor loss.

Other configurations, modifications, and functions and advantages of this embodiment are completely the same as these of the embodiment in FIGS. 1*a* and 1*b*.

Figure 5A:
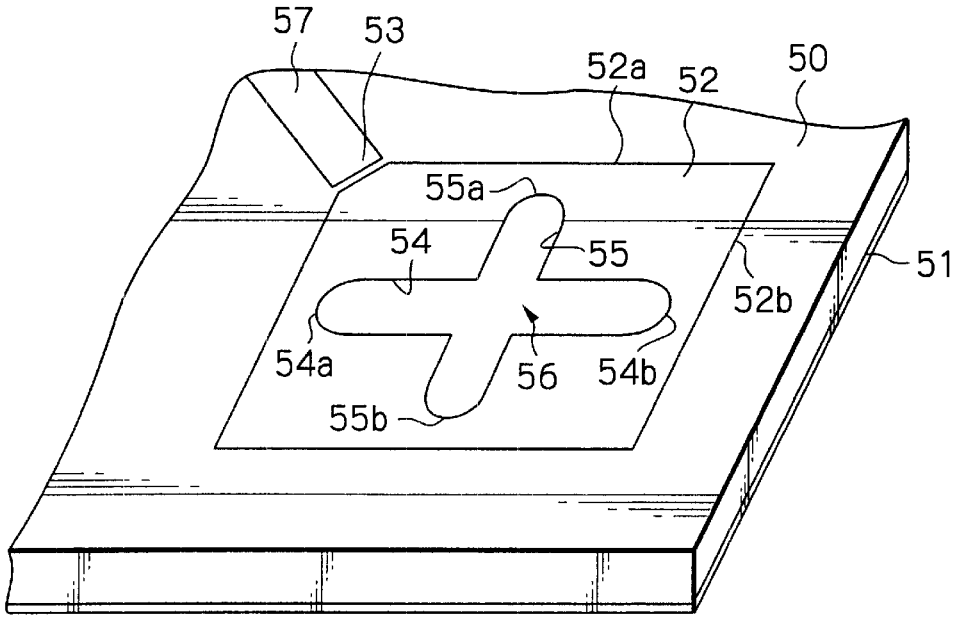
FIG. 5*a* is a perspective view schematically illustrating a configuration of a further embodiment of the microstrip antenna according to the present invention.
Figure 5B:
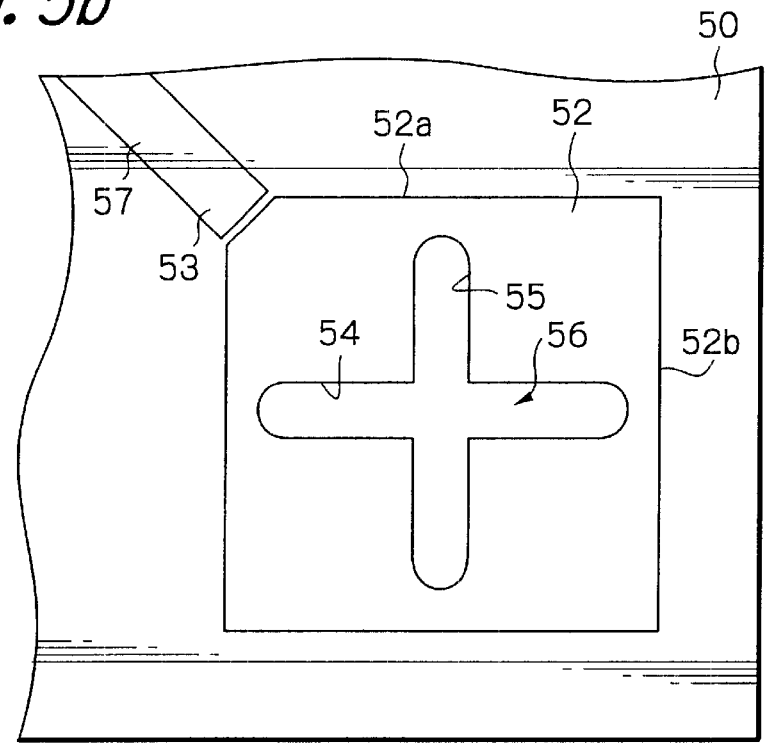
FIG. 5*b* is a top view illustrating a radiating conductor pattern of the microstrip antenna shown in FIG. 5*a;*

FIGS. 5*a* and 5*b* schematically illustrate a configuration of a further embodiment of the microstrip antenna according to the present invention, in which FIG. 5*a* is a perspective view of the configuration and FIG. 5*b* is a top view illustrating a radiating conductor pattern of the configuration.

This embodiment is an example in which other circuit devices such as active circuits and/or a plurality of antennas are formed on the same dielectric substrate.

In these figures, reference numeral 50 denotes a dielectric substrate, 51 denotes a ground plate conductor (ground electrode) formed over antenna area on the back surface of the dielectric substrate 50, 52 denotes a square or rectangular radiating conductor (patch electrode) formed on the front surface of the dielectric substrate 50, and 53 denotes a power-supply terminal.

The dielectric substrate 50 is made of a high-frequency-purposed ceramic dielectric material having a relative dielectric constant $\epsilon_r$90. The thickness of the substrate 50 is set to a value equal to or less than a ¼ wavelength of a frequency used.

The ground plate conductor 51 and radiating conductor 52 are respectively formed by patterning a metallic conductor layer made of copper or silver on the back and front surfaces of the dielectric substrate 50. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 53 is formed on the extension line of a diagonal line of the radiating conductor 52 at a corner of the radiating conductor 52 facing the inside of a substrate by cutting out a part of the radiating conductor 52 into a triangle shape and electrically connected to the radiating conductor 52 by an electrostatic coupling pattern. The power-supply terminal 53 is electrically connected to a transceiver circuit on the dielectric substrate 50 through a power-supply conductor 57 formed on the same front surface of the dielectric substrate 50.

Since the power-supply terminal 53 is formed as an electrostatic coupling pattern obtained by cutting out a part of the radiating conductor 52, the structure of the terminal 52 is greatly simplified, fabrication of the terminal 53 becomes easy, and moreover mounting of the terminal 53 becomes easy because connection of the terminal 53 with other circuit can be performed only by the same surface. Moreover, by forming the radiating conductor 52 as large as possible in the limited surface area of the dielectric substrate 50, it is possible to improve the area-utilization efficiency and the radiation efficiency.

A crossed slot 56 constituted of two arms 54 and 55 parallel with orthogonal sides 52*a* and 52*b* of the radiating conductor 52 is formed on the radiating conductor 52. When the shape of the radiating conductor 52 is square, these arms 54 and 55 tilt by ±45° from the diagonal line on which a power-supply point is present.

Lengths of these arms 54 and 55 are different from each other and both ends 54*a* and 54*b* of the arm 54 and both ends 55*a* and 55*b* of the arm 55 are respectively rounded like a circular arc. By making lengths of the arms 54 and 55 different from each other to shift resonance frequencies of two orthogonal resonance modes from each other in order to obtain a double-resonance characteristic, the operating band of an antenna can be widened.

Also, the length of the arm 54 or 55 is set to a value equal to or more than a value obtained by subtracting 4T that is a four times value of the thickness T of the dielectric substrate 50 from the length of the side 52*a* or 52*b* of a radiating conductor along the arm 54 or 55. This means that, if central points of the arms 54 and 55 are located at the center of the radiating conductor 52, the distance between the top end of the arm 54 or 55 and the outer edge of the radiating conductor 52 is set to a value equal to or less than 2T that is a double value of the thickness T of the dielectric substrate 50. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

Moreover, since the ends 54*a* and 54*b* and 55*a* and 55*b* of arms of the slot are rounded, it is prevented that current is concentrated on a part of these ends and the conductor loss increases. That is, current smoothly flows through the ends and the conductor loss can be reduced without causing a pattern to increase in size. Therefore, it is possible to raise the Q due to the conductor loss.

Other configurations, modifications, and functions and advantages of this embodiment are completely the same as these of the embodiments in FIGS. 1*a* and 1*b* and FIGS. 4*a* and 4*b*.

Figure 6A:
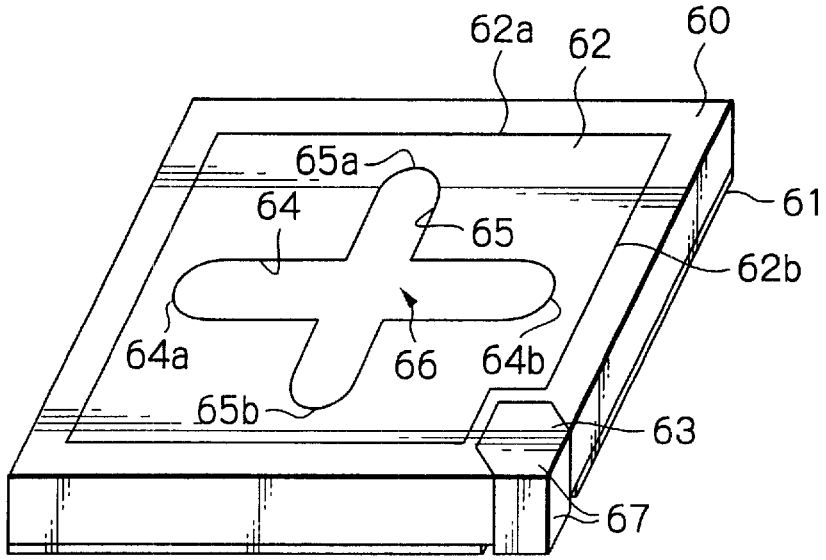
FIG. 6*a* is a perspective view schematically illustrating a configuration of a still further embodiment of the microstrip antenna according to the present invention.
Figure 6B:
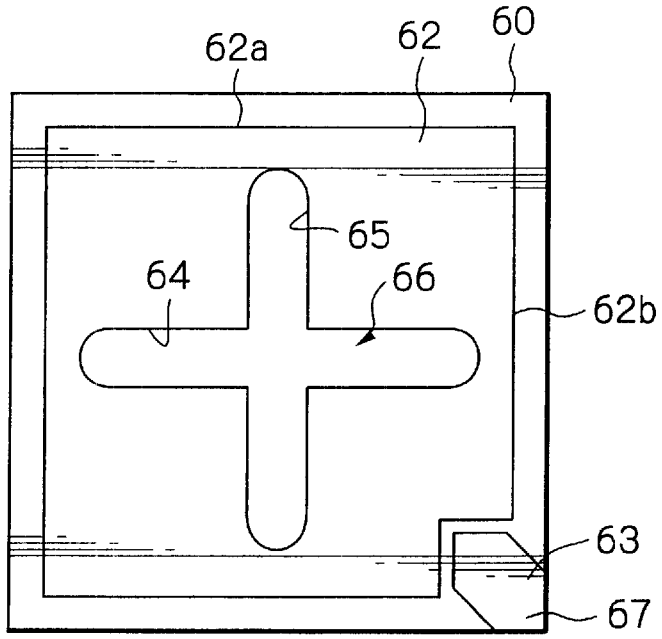
FIG. 6*b* is a top view illustrating a radiating conductor pattern of the microstrip antenna shown in FIG. 6*a;*

FIGS. 6*a* and 6*b* schematically illustrate a configuration of a still further embodiment of the microstrip antenna according to the present invention, in which FIG. 6*a* is a perspective view of the configuration and FIG. 6*b* is a top view illustrating a radiating conductor pattern of the configuration.

In these figures, reference numeral 60 denotes a dielectric substrate, 61 denotes a ground plate conductor (ground electrode) formed over the entire area except the power-supply electrode on the back surface of the dielectric substrate 60, 62 denotes a square or rectangular radiating conductor (patch electrode) formed on the front surface of the dielectric substrate 60, and 63 denotes a power-supply terminal.

The dielectric substrate 60 is made of a high-frequency-purposed ceramic dielectric material having a relative dielectric constant $\epsilon_r \approx 90$. The thickness of the substrate 60 is set to a value equal to or less than a ¼ wavelength of a frequency used.

The ground plate conductor 61 and radiating conductor 62 are respectively formed by patterning a metallic conductor layer made of copper or silver on the back and front surfaces of the dielectric substrate 60. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 63 is formed on the extension line of a diagonal line of the radiating conductor 62 at a corner of the radiating conductor 62 by cutting out a part of the radiating conductor 62 into a rectangle shape and electrically connected to the radiating conductor 62 by an electrostatic coupling pattern. The power-supply terminal 63 is electrically connected to a not-illustrated power-supply electrode formed on the back surface of the dielectric substrate 60 through a power-supply conductor 67 passing through the side face of the dielectric substrate 60. The power-supply electrode is electrically insulated from the ground plate conductor 61 and will be connected to a transceiver circuit or the like.

Since the power-supply terminal 63 is formed as an electrostatic coupling pattern obtained by cutting out a part of the radiating conductor 62, the structure of the terminal 63 is greatly simplified, fabrication of the terminal 63 becomes easy, and mounting of the terminal 63 becomes easy because connection of the terminal 63 with other circuit can be performed only by the surface. Moreover, by forming the radiating conductor 62 as large as possible in the limited surface area of the dielectric substrate 60, it is possible to improve the area-utilization efficiency and the radiation efficiency.

A crossed slot 66 constituted of two arms 64 and 65 parallel with orthogonal sides 62*a* and 62*b* of the radiating conductor 62 is formed on the radiating conductor 62. When the shape of the radiating conductor 62 is square, these arms 64 and 65 tilt by ±45° from a diagonal line on which a power-supply point is present.

Lengths of these arms 64 and 65 are different from each other and both ends 64*a* and 64*b* of the arm 64 and both ends 65*a* and 65*b* of the arm 65 are respectively rounded like a circular arc. By making lengths of the arms 64 and 65 different from each other to shift resonance frequencies of two orthogonal resonance modes from each other in order to obtain a double-resonance characteristic, the operating band of an antenna can widened.

Also, the length of the arm 64 or 65 is set to a value equal to or more than a value obtained by subtracting 4T that is a four times value of the thickness T of the dielectric substrate 60 from the length of the side 62*a* or 62*b* of the radiating conductor along the arm 64 or 65. This means that, if central points of the arms 64 and 65 are located at the center of the radiating conductor 62, the distance between the top end of the arm 64 or 65 and the outer edge of the radiating conductor 62 is set to a value equal to or less than 2T that is a double value of the thickness T of the dielectric substrate 60. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

Moreover, since the ends 64*a* and 64*b* and 65*a* and 65*b* of arms of the slot are rounded, it is prevented that current is concentrated on a part of these ends and the conductor loss increases. That is, current smoothly flows through the ends and the conductor loss can be reduced without causing a pattern to increase in size. Therefore, it is possible to raise the Q due to the conductor loss.

Other configurations, modifications, and functions and advantages of this embodiment are completely the same as these of the embodiments in FIGS. 1*a* and 1*b* and FIGS. 4*a* and 4*b*.

Figure 7A:
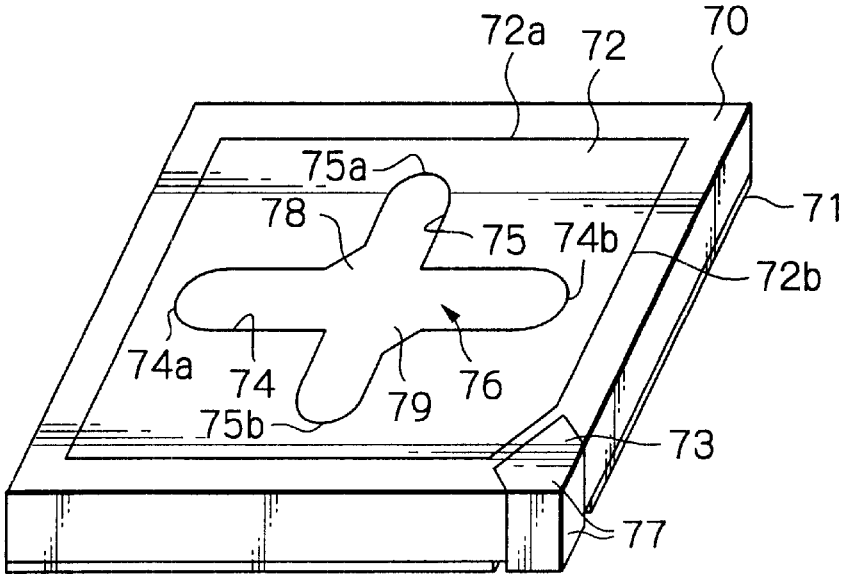
FIG. 7*a* is a perspective view schematically illustrating a configuration of a further embodiment of the microstrip antenna according to the present invention.
Figure 7B:
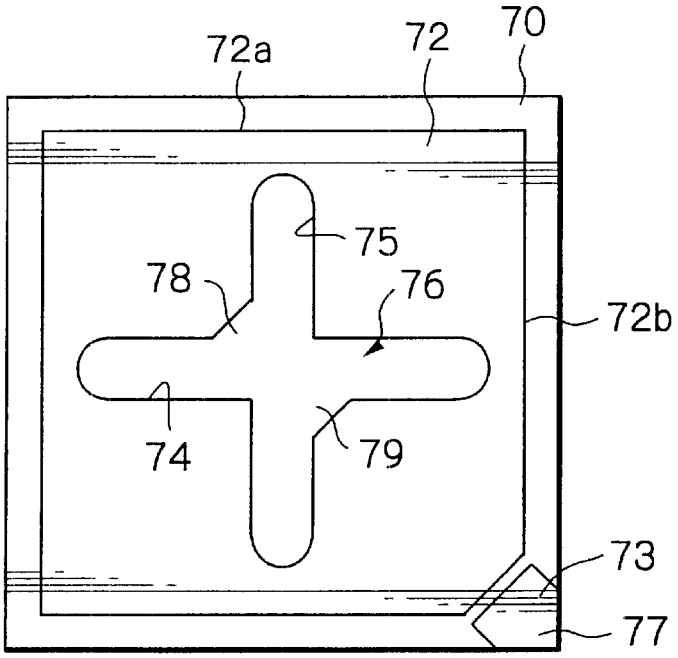
FIG. 7*b* is a top view illustrating a radiating conductor pattern of the microstrip antenna shown in FIG. 7*a;*

FIGS. 7*a* and 7*b* schematically illustrate a configuration of a further embodiment of the microstrip antenna according to the present invention, in which FIG. 7*a* is a perspective view of the configuration and FIG. 7*b* is a top view illustrating a radiating conductor pattern of the configuration.

In these figures, reference numeral 70 denotes a dielectric substrate, 71 denotes a ground plate conductor (ground electrode) formed over the entire area except the power-supply electrode on the back surface of the dielectric substrate 70, 72 denotes a square or rectangular radiating conductor (patch electrode) formed on the front surface of the dielectric substrate 70, and 73 denotes a power-supply terminal.

The dielectric substrate 70 is made of a high-frequency-purposed ceramic dielectric material having a relative dielectric constant $\epsilon_r \approx 90$. The thickness of the substrate 70 is set to a value equal to or less than a ¼ wavelength of a frequency used.

The ground plate conductor 71 and radiating conductor 72 are respectively formed by patterning a metallic conductor layer made of copper or silver on the back and front surfaces of the dielectric substrate 70. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 73 is formed on the extension line of a diagonal line of the radiating conductor 72 at a corner of the radiating conductor 72 by cutting out a part of the radiating conductor 72 into a triangle shape and electrically connected to the radiating conductor 72 by an electrostatic coupling pattern. The power-supply terminal 73 is electrically connected to a not-illustrated power-supply electrode formed on the back surface of the dielectric substrate 70 through a power-supply conductor 77 passing through the side face of the dielectric substrate 70. The power-supply electrode is electrically insulated from the ground plate conductor 71 and will be connected to a transceiver circuit or the like.

Since the power-supply terminal 73 is formed as an electrostatic coupling pattern obtained by cutting out a part of the radiating conductor 72, the structure of the terminal 73 is greatly simplified, fabrication of the terminal 73 becomes easy, and moreover mounting of the terminal 73 becomes easy because connection of the terminal 73 with other circuit can be performed only by the surface. Moreover, by forming the radiating conductor 72 as large as possible in the limited surface area of the dielectric substrate 70, it is possible to improve the area-utilization efficiency and the radiation efficiency.

A crossed slot 76 constituted of two arms 74 and 75 parallel with orthogonal sides 72*a* and 72*b* of the radiating conductor 72 is formed on the radiating conductor 72. When the shape of the radiating conductor 72 is square, these arms 74 and 75 tilt by ±45° from a diagonal line on which a power-supply point is present.

Lengths of these arms 74 and 75 are different from each other and both ends 74*a* and 74*b* of the arm 74 and both ends 75*a* and 75*b* of the arm 75 are respectively rounded like a circular arc. By making lengths of the arms 74 and 75 different from each other to shift resonance frequencies of two orthogonal resonance modes from each other in order to obtain a double-resonance characteristic, the operating band of an antenna can be widened.

Also, the length of the arm 74 or 75 is set to a value equal to or more than a value obtained by subtracting 4T that is a four times value of the thickness T of the dielectric substrate 70 from the length of the side 72*a* or 72*b* of a radiating conductor along the arm 74 or 75. This means that, if central points of the arms 74 and 75 are located at the center of the radiating conductor 72, the distance between the top end of the arm 74 or 75 and the outer edge of the radiating conductor 72 is set to a value equal to or less than 2T that is a double value of the thickness T of the dielectric substrate 70. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

In this embodiment, particularly, two cutouts 78 and 79 are formed at the crossing portion of the slot 76 on a diagonal line on which the power-supply terminal 73 of the radiating conductor 72 is present. These cutouts 78 and 79 are used to adjust the impedance characteristic and frequency characteristic of the antenna. Particularly, when the power-supply terminal 73 is formed by cutting out a part of the radiating conductor 72, these cutouts 78 and 79 make it possible to correct an asymmetric distortion of current in an orthogonal resonance mode due to its degeneration separation effect. That is, by forming these cutouts, it is possible to make a voltage standing wave ratio (VSWR) approach to one so as to improve the radiation efficiency.

Furthermore, in this embodiment, since these cutouts 78 and 79 are formed not on the outer edge portion of the radiating conductor 72 but at the inner crossing portion of the slot 76, it is possible to form the radiating conductor 72 as large as possible in the limited surface area of the dielectric substrate 70 so as to improve the area-utilization efficiency and thereby further improve the radiation efficiency.

Since the ends 74*a* and 74*b* and 75*a* and 75*b* of arms of a slot are rounded, it is prevented that current is concentrated on a part of these ends and the conductor loss increases. That is, the current at the ends smoothly flows and it is possible to reduce the conductor loss without causing a pattern to increase in size. Therefore, it is possible to improve the Q due to the conductor loss.

Other configurations, modifications, and functions and advantages of this embodiment are completely the same as these of the embodiments in FIGS. 1*a* and 1*b* and FIGS. 4*a* and 4*b*.

Figure 8A:
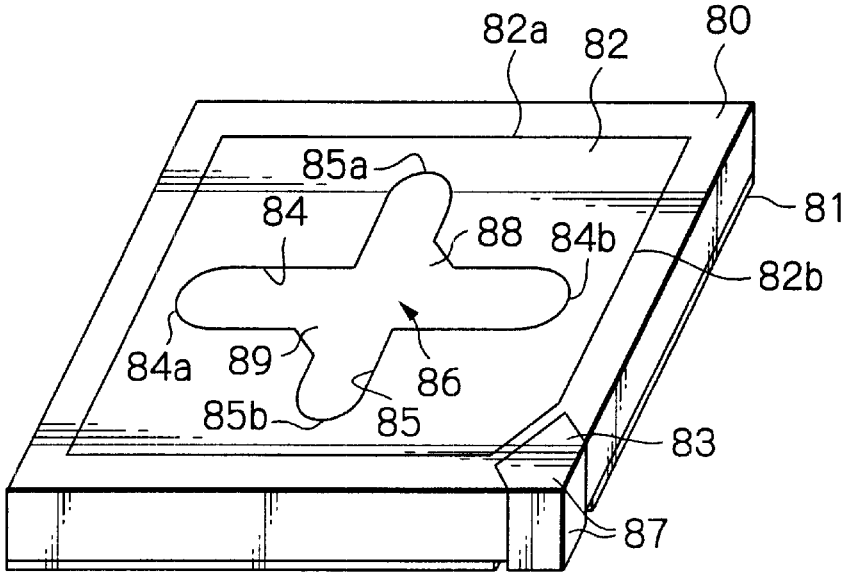
FIG. 8*a* is a perspective view schematically illustrating a configuration of a still further embodiment of the microstrip antenna according to the present invention.
Figure 8B:
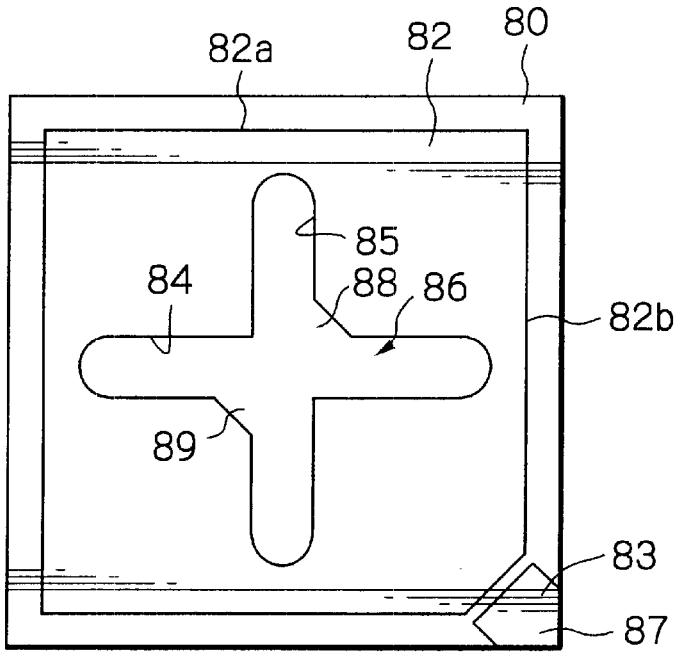
FIG. 8*b* is a top view illustrating a radiating conductor pattern of the microstrip antenna shown in FIG. 8*a;*

FIGS. 8*a* and 8*b* schematically illustrate a configuration of a still further embodiment of the microstrip antenna according to the present invention, in which FIG. 8*a* is a perspective view of the configuration and FIG. 8*b* is a top view illustrating a radiating conductor pattern of the configuration.

In these figures, reference numeral 80 denotes a dielectric substrate, 81 denotes a ground plate conductor (ground electrode) formed over the entire area except the power-supply electrode on the back surface of the dielectric substrate 80, 82 denotes a square or rectangular radiating conductor (patch electrode) formed on the front surface of the dielectric substrate 80, and 83 denotes a power-supply terminal.

The dielectric substrate 80 is made of a high-frequency-purposed ceramic dielectric material having a relative dielectric constant $\epsilon_r \approx 90$. The thickness of the substrate 80 is set to a value equal to or less than a ¼ wavelength of a frequency used.

The ground plate conductor 81 and radiating conductor 82 are respectively formed by patterning a metallic conductor layer made of copper or silver on the back and front surfaces of the dielectric substrate 80. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 83 is formed on the extension line of a diagonal line of the radiating conductor 82 at a corner of the radiating conductor 82 by cutting out a part of the radiating conductor 82 into a triangle shape and electrically connected to the radiating conductor 82 by an electrostatic coupling pattern. The power-supply terminal 83 is electrically connected to a not-illustrated power-supply electrode formed on the back surface of the dielectric substrate 80 through a power-supply conductor 87 passing through the side face of the dielectric substrate 80. The power-supply electrode is electrically insulated from the ground plate conductor 81 and will be connected to a transceiver circuit or the like.

Since the power-supply terminal 83 is formed as an electrostatic coupling pattern obtained by cutting out a part of the radiating conductor 82, the structure of the terminal 83 is greatly simplified, fabrication of the terminal 83 becomes easy, and moreover mounting of the terminal 83 becomes easy because connection of the terminal 83 with other circuit can be performed only by the surface. Moreover, by forming the radiating conductor 82 as large as possible in the limited surface area of the dielectric substrate 80, it is possible to improve the area-utilization efficiency and the radiation efficiency.

A crossed slot 86 constituted of two arms 84 and 85 parallel with orthogonal sides 82*a* and 82*b* of the radiating conductor 82 is formed on the radiating conductor 82. When the shape of the radiating conductor 82 is square, these arms 84 and 85 tilt by ±45° from a diagonal line on which a power-supply point is present.

Lengths of these arms 84 and 85 are different from each other and both ends 84*a* and 84*b* of the arm 84 and both ends 85*a* and 85*b* of the arm 85 are respectively rounded like a circular arc. By making lengths of the arms 84 and 85 different from each other to shift resonance frequencies of two orthogonal resonance modes from each other so as to obtain a double-resonance characteristic, the operating band of an antenna can widened.

Also, the length of the arm 84 or 85 is set to a value equal to or more than a value obtained by subtracting 4T that is a four times value of the thickness T of the dielectric substrate 80 from the length of the side 82*a* or 82*b* of a radiating conductor along the arm 84 or 85. This means that if central points of the arms 84 and 85 are located at the center of the radiating conductor 82, the distance between the top end of the arm 84 or 85 and the outer edge of the radiating conductor 82 is set to a value equal to or less than 2T that is a double value of the thickness T of the dielectric substrate 80. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

In this embodiment, particularly, two cutouts 88 and 89 are formed at the crossing portion of the slot 86 on a diagonal line on which the power-supply terminal 83 of the radiating conductor 82 is not present. These cutouts 88 and 89 are used to adjust the impedance characteristic and frequency characteristic of the antenna. Particularly, when the power-supply terminal 83 is formed by cutting out a part of the radiating conductor 82, these cutouts 88 and 89 make it possible to correct an asymmetric distortion of current in an orthogonal resonance mode due to its degeneration separation effect. That is, by forming these cutouts, it is possible to make a voltage standing wave ratio (VSWR) approach to one so as to improve the radiation efficiency.

Furthermore, in this embodiment, since these cutouts 88 and 89 are formed not on the outer edge portion of the radiating conductor 82 but at the inner crossing portion of the slot 86, it is possible to form the radiating conductor 82 as large as possible in the limited surface area of the dielectric substrate 80 so as to improve the area-utilization efficiency and thereby further improve the radiation efficiency.

In addition, since the ends 84*a* and 84*b* and 85*a* and 85*b* of arms of a slot are rounded, it is prevented that current is concentrated on some of these ends and the conductor loss increases. That is, the current at the ends smoothly flows and it is possible to reduce the conductor loss without causing a pattern to increase in size. Therefore, it is possible to improve the Q due to the conductor loss.

Other configurations, modifications, and functions and advantages of this embodiment are completely the same as these of the embodiments in FIGS. 1*a* and 1*b* and FIGS. 4*a* and 4*b*.

Figure 9A:
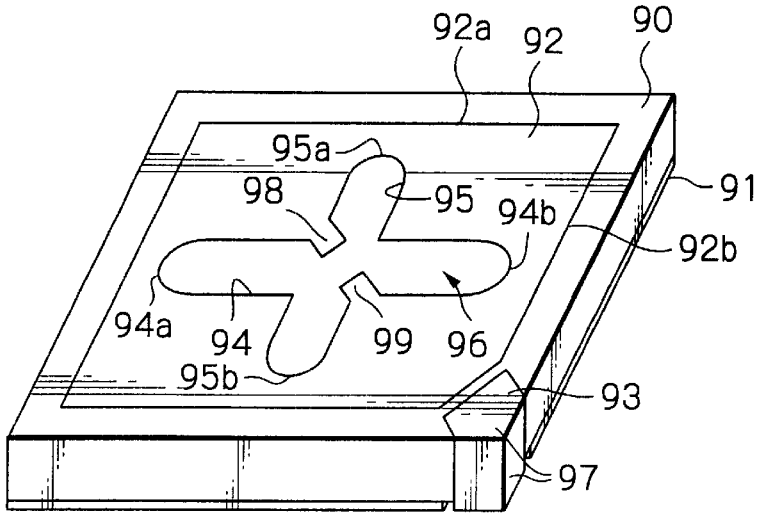
FIG. 9*a* is a perspective view schematically illustrating a configuration of a further embodiment of the microstrip antenna according to the present invention.
Figure 9B:
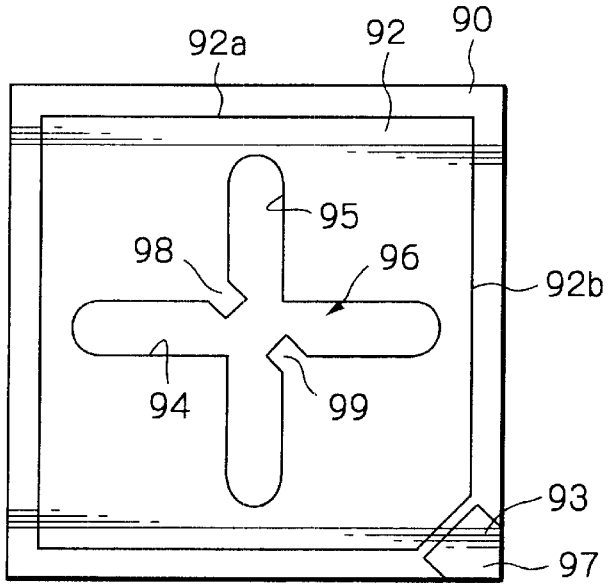
FIG. 9*b* is a top view illustrating a radiating conductor pattern of the microstrip antenna shown in FIG. 9*a;*

FIGS. 9*a* and 9*b* schematically illustrate a configuration of a further of the microstrip antenna according to the present invention, in which FIG. 9*a* is a perspective view of the configuration and FIG. 9*b* is a top view illustrating a radiating conductor pattern of the configuration.

In these figures, reference numeral 90 denotes a dielectric substrate, 91 denotes a ground plate conductor (ground electrode) formed over the entire area except the power-supply electrode on the back surface of the dielectric substrate 90, 92 denotes a square or rectangular radiating conductor (patch electrode) formed on the front surface of the dielectric substrate 90, and 93 denotes a power-supply terminal.

The dielectric substrate 90 is made of a high-frequency-purposed ceramic dielectric material having a relative dielectric constant $\epsilon_r \approx 90$. The thickness of the substrate 90 is set to a value equal to or less than a ¼ wavelength of a frequency used.

The ground plate conductor 91 and radiating conductor 92 are respectively formed by patterning a metallic conductor layer made of copper or silver on the back and front surfaces of the dielectric substrate 90. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 93 is formed on the extension line of a diagonal line of the radiating conductor 92 at a corner of the radiating conductor 92 by cutting out a part of the radiating conductor 92 into a triangle shape and electrically connected to the radiating conductor 92 by an electrostatic coupling pattern. The power-supply terminal 93 is electrically connected to a not-illustrated power-supply electrode formed on the back surface of the dielectric substrate 90 through a power-supply conductor 97 passing through the side face of the dielectric substrate 90. The power-supply electrode is electrically insulated from the ground plate conductor 91 and will be connected to a transceiver circuit or the like.

Since the power-supply terminal 93 is formed as an electrostatic coupling pattern obtained by cutting out a part of the radiating conductor 92, the structure of the terminal 93 is greatly simplified, fabrication of the terminal 93 becomes easy, and moreover mounting of the terminal 93 becomes easy because connection of the terminal 93 with other circuit can be performed only by the surface. Moreover, by forming the radiating conductor 92 as large as possible in the limited surface area of the dielectric substrate 90, it is possible to improve the area-utilization efficiency and the radiation efficiency.

A crossed slot 96 constituted of two arms 94 and 95 parallel with orthogonal sides 92*a* and 92*b* of the radiating conductor 92 is formed on the radiating conductor 92. When the shape of the radiating conductor 92 is square, these arms 94 and 95 tilt by ±45° from a diagonal line on which a power-supply point is present.

Lengths of these arms 94 and 95 are different from each other and both ends 94*a* and 94*b* of the arm 94 and both ends 95*a* and 95*b* of the arm 95 are respectively rounded like a circular arc. By making lengths of the arms 94 and 95 different from each other to shift resonance frequencies of two orthogonal resonance modes from each other in order to obtain a double-resonance characteristic, the operating band of an antenna can widened.

Also, the length of the arm 94 or 95 is set to a value equal to or more than a value obtained by subtracting 4T that is a four times value of the thickness T of the dielectric substrate 90 from the length of the side 92*a* or 92*b* of a radiating conductor along the arm 94 or 95. This means that if central points of the arms 94 and 95 are located at the center of the radiating conductor 92, the distance between the top end of the arm 94 or 95 and the outer edge of the radiating conductor 92 is set to a value equal to or less than 2T that is a double value of the thickness T of the dielectric substrate 90. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

In this embodiment, particularly, two stubs 98 and 99 are formed at the crossing portion of the slot 96 on a diagonal line on which the power-supply terminal 93 of the radiating conductor 92 is present. These stubs 98 and 99 are used to adjust the impedance characteristic and frequency characteristic of the antenna. Particularly, when the power-supply terminal 93 is formed by cutting out a part of the radiating conductor 92, these stubs 98 and 99 make it possible to correct an asymmetric distortion of current in an orthogonal resonance mode due to its degeneration separation effect. That is, by forming these stubs, it is possible to make a voltage standing wave ratio (VSWR) approach to one so as to improve the radiation efficiency.

Furthermore, in this embodiment, since these stubs 98 and 99 are formed not on the outer edge portion of the radiating conductor 92 but at the inner crossing portion of the slot 96, it is possible to form the radiating conductor 92 as large as possible in the limited surface area of the dielectric substrate 90 so as to improve the area-utilization efficiency and thereby further improve the radiation efficiency.

In addition, since the ends 94*a* and 94*b* and 95*a* and 95*b* of arms of a slot are rounded, it is prevented that current is concentrated on a part of these ends and the conductor loss increases. That is, the current at the ends smoothly flows and it is possible to reduce the conductor loss without causing a pattern to increase in size. Therefore, it is possible to improve the Q due to the conductor loss.

Other configurations, modifications, and functions and advantages of this embodiment are completely the same as these of the embodiments in FIGS. 1*a* and 1*b* and FIGS. 4*a* and 4*b*.

Figure 10A:
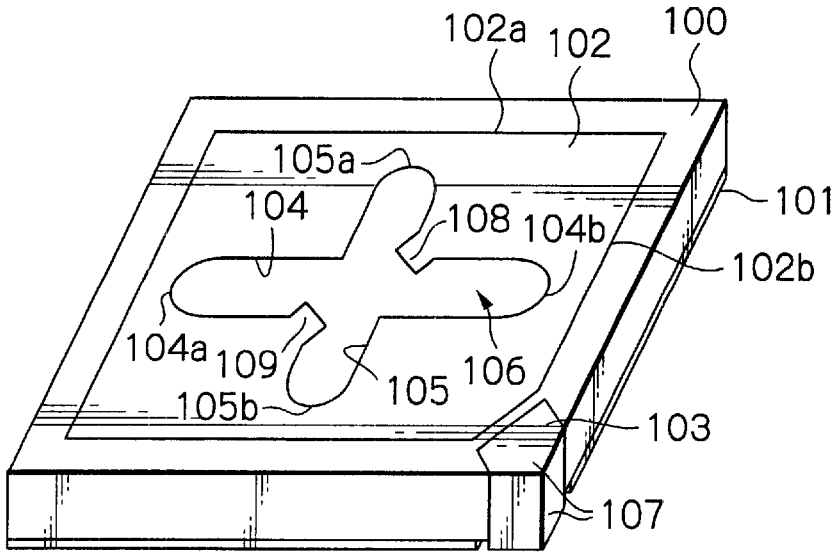
FIG. 10*a* is a perspective view schematically illustrating a configuration of a still further embodiment of the microstrip antenna according to the present invention.
Figure 10B:
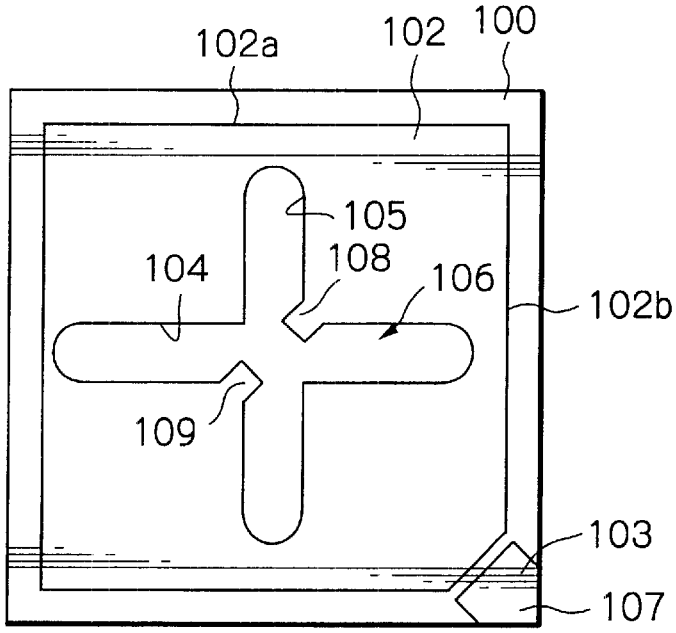
FIG. 10*b* is a top view illustrating a radiating conductor pattern of the microstrip antenna shown in FIG. 10*a;*

FIGS. 10*a* and 10*b* schematically illustrate a configuration of a still further embodiment of the microstrip antenna of the present invention, in which FIG. 10*a* is a perspective view of the configuration and FIG. 10*b* is a top view illustrating a radiating conductor pattern of the configuration.

In these figures, reference numeral 100 denotes a dielectric substrate, 101 denotes a ground plate conductor (ground electrode) formed over the entire area except the power-supply electrode on the back surface of the dielectric substrate 100, 102 denotes a square or rectangular radiating conductor (patch electrode) formed on the surface of the dielectric substrate 100, and 103 denotes a power-supply terminal.

The dielectric substrate 100 is made of a high-frequency-purposed ceramic dielectric material having a relative dielectric constant $\epsilon_r \approx 90$. The thickness of the substrate 100 is set to a value equal to or less than a ¼ wavelength of a frequency used.

The ground plate conductor 101 and radiating conductor 102 are respectively formed by patterning a metallic conductor layer made of copper or silver on the back and front surfaces of the dielectric substrate 100. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 103 is formed on the extension line of a diagonal line of the radiating conductor 102 at a corner of the radiating conductor 102 by cutting out a part of the radiating conductor 102 into a triangle shape and electrically connected to the radiating conductor 102 by an electrostatic coupling pattern. The power-supply terminal 103 is electrically connected to a not-illustrated power-supply electrode formed on the back surface of the dielectric substrate 100 through a power-supply conductor 107 passing through the side face of the dielectric substrate 100. The power-supply electrode is electrically insulated from the ground plate conductor 101 and will be connected to a transceiver circuit or the like.

Since the power-supply terminal 103 is formed as an electrostatic coupling pattern obtained by cutting out a part of the radiating conductor 102, the structure of the terminal 103 is greatly simplified, fabrication of the terminal 103 becomes easy, and moreover mounting of the terminal 103 becomes easy because connection of the terminal 103 with other circuit can be performed only by the surface. Moreover, by forming the radiating conductor 102 as large as possible in the limited surface area of the dielectric substrate 100, it is possible to improve the area-utilization efficiency and the radiation efficiency.

A crossed slot 106 constituted of two arms 104 and 105 parallel with orthogonal sides 102*a* and 102*b* of the radiating conductor 102 is formed on the radiating conductor 102. When the shape of the radiating conductor 102 is square, these arms 104 and 105 tilt by ±45° from a diagonal line on which a power-supply point is present.

Lengths of these arms 104 and 105 are different from each other and both ends 104*a* and 104*b* of the arm 104 and both ends 105*a* and 105*b* of the arm 105 are respectively rounded like a circular arc. By making lengths of the arms 104 and 105 different from each other to shift resonance frequencies of two orthogonal resonance modes from each other in order to obtain a double-resonance characteristic, the operating band of an antenna can widened.

Also, the length of the arm 104 or 105 is set to a value equal to or more than a value obtained by subtracting 4T that is a four times value of the thickness T of the dielectric substrate 100 from the length of the side 102*a* or 102*b* of a radiating conductor along the arm 104 or 105. This means that if central points of the arms 104 and 105 are located at the center point of the radiating conductor 102, the distance between the top end of the arm 104 or 105 and the outer edge of the radiating conductor 102 is set to a value equal to or less than 2T that is a double value of the thickness T of the dielectric substrate 100. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

In this embodiment, particularly, two stubs 108 and 109 are formed at the crossing portion of the slot 106 on a diagonal line on which the power-supply terminal 103 of the radiating conductor 102 is not present. These stubs 108 and 109 are used to adjust the impedance characteristic and frequency characteristic of the antenna. Particularly, when the power-supply terminal 103 is formed by cutting out a part of the radiating conductor 102, these stubs 108 and 109 make it possible to correct an asymmetric distortion of current in an orthogonal resonance mode due to its degeneration separation effect. That is, by forming these stubs, it is possible to make a voltage standing wave ratio (VSWR) approach to one so as to improve the radiation efficiency.

Furthermore, in this embodiment, since these stubs 108 and 109 are formed not on the outer edge portion of the radiating conductor 102 but at the inner crossing portion of the slot 106, it is possible to form the radiating conductor 102 as large as possible in the limited surface area of the dielectric substrate 100 so as to improve the area-utilization efficiency and thereby further improve the radiation efficiency.

In addition, since the ends 104*a* and 104*b* and 105*a* and 105*b* of arms of a slot are rounded, it is prevented that current is concentrated on a part of these ends and the conductor loss increases. That is, the current at the ends smoothly flows and it is possible to reduce the conductor loss without causing a pattern to increase in size. Therefore, it is possible to improve the Q due to the conductor loss.

Other configurations, modifications, and functions and advantages of this embodiment are completely the same as these of the embodiments in FIGS. 1*a* and 1*b* and FIGS. 4*a* and 4*b*.

Figure 11A:
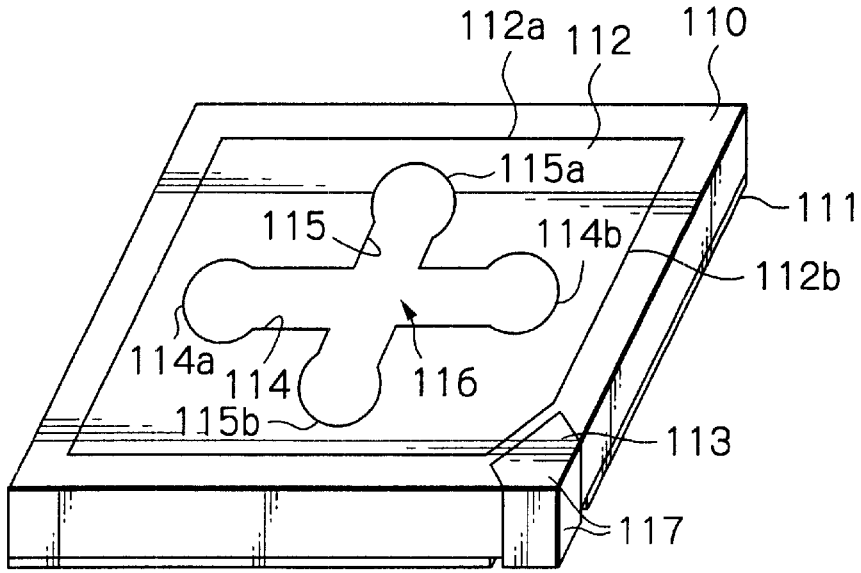
FIG. 11*a* is a perspective view schematically illustrating a configuration of a further embodiment of the microstrip antenna according to the present invention.
Figure 11B:
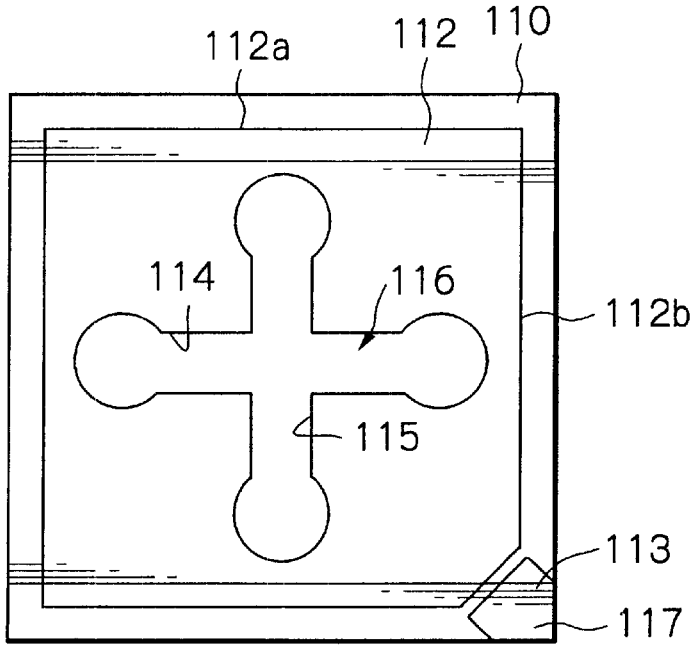
FIG. 11*b* is a top view illustrating a radiating conductor pattern of the microstrip antenna shown in FIG. 11*a;*

FIGS. 11*a* and 11*b* schematically illustrate a configuration of a further embodiment of the microstrip antenna according to the present invention, in which FIG. 11*a* is a perspective view of the configuration and FIG. 11*b* is a top view illustrating a radiating conductor pattern of the configuration.

In these figures, reference numeral 110 denotes a dielectric substrate, 111 denotes a ground plate conductor (ground electrode) formed over the entire area except the power-supply electrode on the back surface of the dielectric substrate 110, 112 denotes a square or rectangular radiating conductor (patch electrode) formed on the surface of the dielectric substrate 110, and 113 denotes a power-supply terminal.

The dielectric substrate 110 is made of a high-frequency-purposed ceramic dielectric material having a relative dielectric constant $\epsilon_r \approx 90$. The thickness of the substrate 110 is set to a value equal to or less than a ¼ wavelength of a frequency used.

The ground plate conductor 111 and radiating conductor 112 are respectively formed by patterning a metallic conductor layer made of copper or silver on the back and front surfaces of the dielectric substrate 110. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminal 113 is formed on the extension line of a diagonal line of the radiating conductor 112 at a corner of the radiating conductor 112 by cutting out a part of the radiating conductor 112 into a triangle shape and electrically connected to the radiating conductor 112 by an electrostatic coupling pattern. The power-supply terminal 113 is electrically connected to a not-illustrated power-supply electrode formed on the back surface of the dielectric substrate 110 through a power-supply conductor 117 passing through the side face of the dielectric substrate 110. The power-supply electrode is electrically insulated from the ground plate conductor 111 and will be connected to a transceiver circuit or the like.

Since the power-supply terminal 113 is formed as an electrostatic coupling pattern obtained by cutting out a part of the radiating conductor 112, the structure of the terminal 113 is greatly simplified, fabrication of the terminal 113 becomes easy, and moreover mounting of the terminal 113 becomes easy because connection of the terminal 113 with other circuit can be performed only by the surface. Moreover, by forming the radiating conductor 112 as large as possible in the limited surface area of the dielectric substrate 110, it is possible to improve the area-utilization efficiency and the radiation efficiency.

A crossed slot 116 constituted of two arms 114 and 115 parallel with orthogonal sides 112*a* and 112*b* of the radiating conductor 112 is formed on the radiating conductor 112. When the shape of the radiating conductor 112 is square, these arms 114 and 115 tilt by ±45° from a diagonal line on which a power-supply point is present.

Lengths of these arms 114 and 115 are different from each other and both ends 114*a* and 114*b* of the arm 114 and both ends 115*a* and 115*b* of the arm 115 are respectively rounded like a circular arc. Particularly, in this embodiment, diameters of the circular arcs of these ends 114*a* and 114*b* and 115*a* and 115*b* are set to values larger than widths of the arms 114 and 115. By making lengths of the arms 114 and 115 different from each other to shift resonance frequencies of two orthogonal resonance modes from each other in order to obtain a double-resonance characteristic, the operating band of an antenna can widened.

Also, the length of the arm 114 or 115 is set to a value equal to or more than a value obtained by subtracting 4T that is a four times value of the thickness T of the dielectric substrate 110 from the length of the side 112*a* or 112*b* of a radiating conductor along the arm 114 or 115. This means that if central points of the arms 114 and 115 are located at the center of the radiating conductor 112, the distance between the top end of the arm 114 or 115 and the outer edge of the radiating conductor 112 is set to a value equal to or less than 2T that is a double value of the thickness T of the dielectric substrate 110. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

Furthermore, since the ends 114*a* and 114*b* and 115*a* and 115*b* of arms of a slot are rounded at a large radius, it is prevented that current is concentrated on some of these ends and the conductor loss increases. That is, the current at the ends smoothly flows and it is possible to reduce the conductor loss without causing a pattern to increase in size. Therefore, it is possible to improve the Q due to the conductor loss.

Other configurations, modifications, and functions and advantages of this embodiment are completely the same as these of the embodiments in FIGS. 1*a* and 1*b* and FIGS. 4*a* and 4*b*.

Figure 12A:
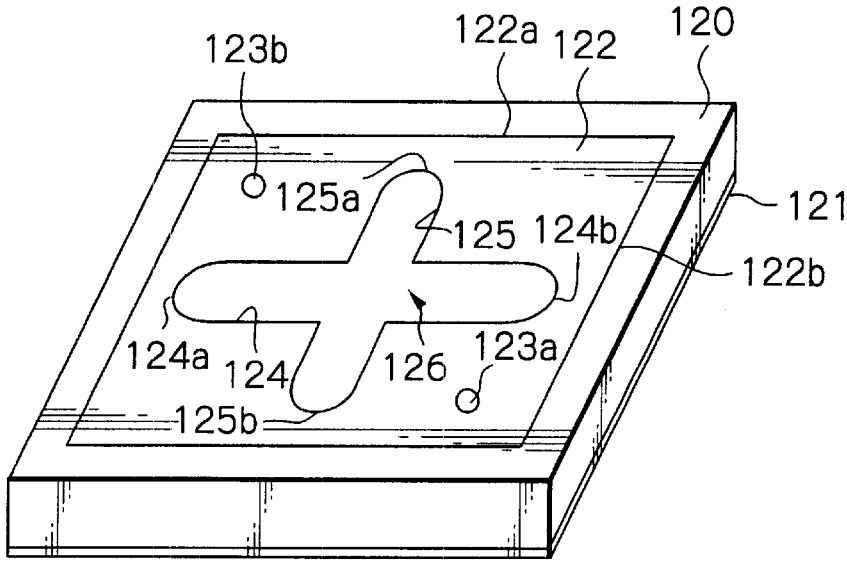
FIG. 12*a* is a perspective view schematically illustrating a configuration of a still further embodiment of the microstrip antenna according to the present invention.
Figure 12B:
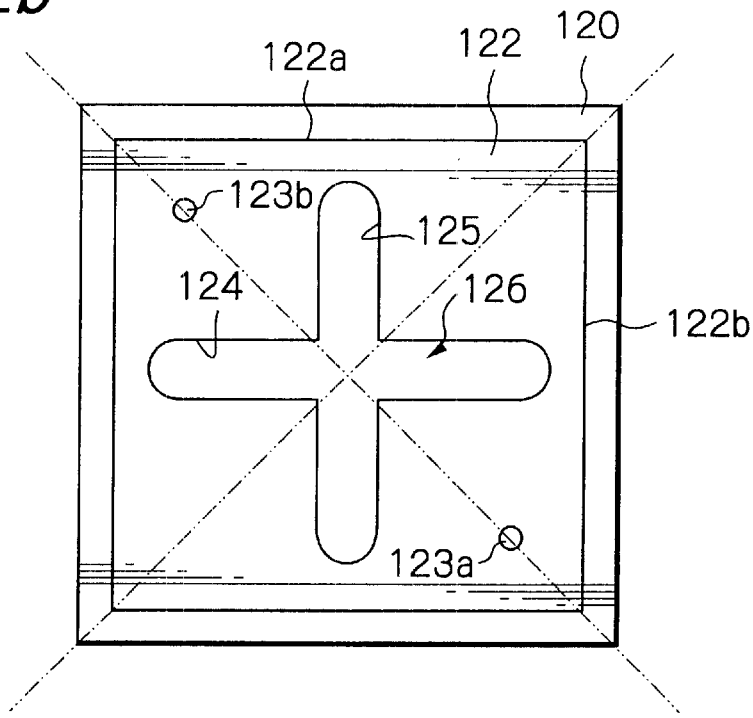
FIG. 12*b* is a top view illustrating a radiating conductor pattern of the microstrip antenna shown in FIG. 12*a.*

FIGS. 12*a* and 12*b* schematically illustrate a configuration of a still further embodiment of the microstrip antenna according to the present invention, in which FIG. 12*a* is a perspective view of the configuration and FIG. 12*b* is a top view illustrating a radiating conductor pattern of the configuration.

In these figures, reference numeral 120 denotes a dielectric substrate, 121 denotes a ground plate conductor (ground electrode) formed over the entire area except the power-supply electrode on the back surface of the dielectric substrate 120, 122 denotes a square or rectangular radiating conductor (patch electrode) formed on the surface of the dielectric substrate 120, and 123*a* and 123*b* denote two power-supply terminals independent with each other.

The dielectric substrate 120 is made of a high-frequency-purposed ceramic dielectric material having a relative dielectric constant $\epsilon_r \approx 90$. The thickness of the substrate 120 is set to a value equal to or less than a ¼ wavelength of a frequency used.

The ground plate conductor 121 and radiating conductor 122 are respectively formed by patterning a metallic conductor layer made of copper or silver on the back and front surfaces of the dielectric substrate 120. Specifically, one of the following methods is used for forming these conductors; a method of pattern-printing metallic paste such as silver and baking it, a method of forming a patterned metallic layer through plating, and a method of patterning a thin metallic film through etching.

In this embodiment, the power-supply terminals 123*a* and 123*b* are formed at positions point-symmetric to the center of the radiating conductor 122 on a diagonal line of the radiating conductor 122 and electrically connected to the radiating conductor 122. A not-illustrated power-supply line is connected to the power-supply terminals 123*a* and 123*b* so as to be connected to a transceiver circuit or the like by passing through the dielectric substrate 120 and being guided to the back surface of the substrate 120. It is a matter of course that these power-supply lines are electrically insulated from the ground plate conductor 121.

Since these two power-supply terminals 123*a* and 123*b* are formed at positions point-symmetric to the center of the radiating conductor 122, it is possible to directly connect these terminals 123*a* and 123*b* to an active circuit such as a differential amplifier or the like and directly supply signals having a phase difference of 180°.

A crossed slot 126 constituted of two arms 124 and 125 parallel with orthogonal sides 122*a* and 122*b* of the radiating conductor 122 is formed on the radiating conductor 122. When the shape of the radiating conductor 122 is square, these arms 124 and 125 tilt by ±45° from a diagonal line on which a power-supply point is present.

Lengths of these arms 124 and 125 are different from each other and both ends 124*a* and 124*b* of the arm 124 and both ends 125*a* and 125*b* of the arm 125 are respectively rounded like a circular arc. By making lengths of the arms 124 and 125 different from each other to shift resonance frequencies of two orthogonal resonance modes from each other in order to obtain a double-resonance characteristic, the operating band of an antenna can widened.

Also, the length of the arm 124 or 125 is set to a value equal to or more than a value obtained by subtracting 4T that is a four times value of the thickness T of the dielectric substrate 120 from the length of the side 122*a* or 122*b* of a radiating conductor along the arm 124 or 125. This means that if central points of the arms 124 and 125 are located at the center of the radiating conductor 122, the distance between the top end of the arm 124 or 125 and the outer edge of the radiating conductor 122 is set to a value equal to or less than 2T that is a double value of the thickness T of the dielectric substrate 120. Each region between the top end of the arm or slot and the outer edge of the radiating conductor locates at the antinode of current in a current route under resonance. Therefore, by decreasing the width of the region of the current route, magnetic field is concentrated on the region to increase the inductance at that region, and the area of the region decreases to lower the capacitance at the region. As mentioned above, by making a region with a low potential more inductive, the resonance frequency lowers resulting that dimensions of a microstrip antenna are further decreased. Particularly, by setting the width of the current route to 2T or less, the downsizing effect can be improved because the reduction rate of the resonance frequency increases.

Furthermore, since the ends 124*a* and 124*b* and 125*a* and 125*b* of arms of the slot are rounded, it is prevented that current is concentrated on some of these ends and the conductor loss increases. That is, the current at the ends smoothly flows and it is possible to reduce the conductor loss without causing a pattern to increase in size. Therefore, it is possible to improve the Q due to the conductor loss.

Other configurations, modifications, and functions and advantages of this embodiment are completely the same as these of the embodiment in FIGS. 1*a* and lb.

The shape of a power-supply terminal according to an electrostatic coupling pattern is not restricted to a triangle or rectangle as the embodiments shown in FIGS. 5*a* and 5*b* to FIGS. 11*a* and 11*b*. Any shape is permitted as long as it is obtained by electrostatically coupling with a radiating conductor and cutting out a corner of the radiating conductor.

Also, the shape of a cutout or stub is not restricted to a triangle or rectangle as the embodiments shown in FIGS. 7*a* and 7*b* to FIGS. 10*a* and 10*b* but any shape is permitted.

In the embodiments shown in FIGS. 1*a* and 1*b*, FIGS. 4*a* and 4*b* to FIGS. 10*a* and 10*b* and FIGS. 12*a* and 12*b*, it is apparent that the shape of the end of each arm of a slot can be formed into the shape in the embodiment shown in FIGS. 11*a* and 11*b*.

As described in detail, according to the present invention, the length of at least one of the two arms of the crossed slot, parallel with orthogonal sides of the radiating conductor is set so as to be equal to or more than a value obtained by subtracting a four times value of the thickness of the dielectric substrate from the length of the side of the radiating conductor in that direction. That is, if it is assumed that a central point of each arm is located at the center of the radiating conductor, the distance between the top end of at least one arm of the slot and outer edge of the radiating conductor is set so that the distance becomes equal to or less than a double value of the thickness of the dielectric substrate. Each region between the top end of the arm or slot and the outer edge of the radiating conductor locates at the antinode of current in a current route under resonance.

Therefore, by decreasing the width of the region of the current route, magnetic field is concentrated on the region to increase the inductance at that region, and the area of the region decreases to lower the capacitance at the region. Thus, by making a region with a low potential more inductive, the resonance frequency lowers resulting that dimensions of a microstrip antenna are further decreased.

Particularly, according to the present invention, the distance between the top end of at least one arm of the slot and the outer edge of the radiating conductor, in other words, the width of a current route serving as an antinode of current in the current route under resonance is set so as to be equal to or less than a double value of the thickness of the dielectric substrate. Therefore, a resonance frequency is greatly lowered and as a result, it is possible to further downsize an antenna.

Many widely different embodiments of the present invention may be constructed without departing from the spirit and scope of the present invention. It should be understood that the present invention is not limited to the specific embodiments described in the specification, except as defined in the appended claims.

What is claimed is:

1. A microstrip antenna, comprising:

a rectangular dielectric substrate;

a ground plate conductor formed on one surface of said dielectric substrate;

a rectangular radiating conductor formed on the other surface of said dielectric substrate;

a crossed slot formed in said radiating conductor and provided with two arms extended along orthogonal sides of said radiating conductor, said two arms having lengths different from each other; and at least one power-supply point formed on a diagonal line of the radiating conductor or an extension line of the diagonal line but different from a center of said radiating conductor, the length of at least one of said arms being equal to or more than a value obtained by subtracting a four times value of a thickness of said dielectric substrate from a length of a side of said radiating conductor along said arm.

2. The microstrip antenna as claimed in claim 1, wherein the length of each arm of the slot is equal to or more than a value obtained by subtracting a four times value of a thickness of said dielectric substrate from a length of a side of said radiating conductor along said arm.

3. The microstrip antenna as claimed in claim 1, wherein ends of said slot are rounded.

4. The microstrip antenna as claimed in claim 1, wherein at least one cutout or stub is formed at a crossing portion of said slot.

5. The microstrip antenna as claimed in claim 4, wherein at least one cutout or stub is formed on a diagonal line of said radiating conductor.

6. The microstrip antenna as claimed in claim 1, wherein said radiating conductor has a square shape and said arms of said slot tilt by ±45° from a diagonal line on which said at least one power-supply point is present.

7. The microstrip antenna as claimed in claim 1, wherein said antenna further comprises an electrostatic coupling pattern constituted by cutting out a part of said radiating conductor to connect said at least one power-supply point with said radiating conductor.

8. The microstrip antenna as claimed in claim 1, wherein a thickness of said di electric substrate is equal to or less than a ¼ wavelength of a frequency used.

9. The microstrip antenna as claimed in claim 1, wherein a length of a side of said dielectric substrate is equal to or less than a value obtained by adding a thickness of said dielectric substrate to a length of a side of said radiating conductor along the side of said dielectric substrate.

10. The microstrip antenna as claimed in claim 1, wherein two power-supply points are provided at two positions that are point-symmetric to a center of said radiating conductor, respectively.

* * * * *